United States Patent [19]

Rigazio et al.

[11] 4,201,293

[45] May 6, 1980

[54] PACKAGE FOR PROTECTION AND DISPLAY OF CLOCKS AND THE LIKE

[75] Inventors: Anthony W. Rigazio, Oglesby; Allen Rubin, Highland Park, both of Ill.

[73] Assignee: Spartus Corporation, Skokie, Ill.

[21] Appl. No.: 3,705

[22] Filed: Jan. 15, 1979

[51] Int. Cl.[2] ..... B65D 5/50; B65D 25/10; B65D 25/54; B65D 81/06; B65D 85/40

[52] U.S. Cl. ..... 206/45.19; 206/45.34; 206/301; 206/480; 206/523; 206/565; 220/4 E

[58] Field of Search ..... 206/45.14, 45.19, 45.34, 206/301, 319, 459, 480–481, 523, 560, 565, 591–592; 220/4 B, 4 E

[56] References Cited

U.S. PATENT DOCUMENTS

| | | | |
|---|---|---|---|
| 2,445,280 | 7/1948 | Powell | 206/45.19 X |
| 2,926,779 | 3/1960 | Jepson | 206/45.19 |
| 3,533,503 | 10/1970 | Woods et al. | 206/45.19 |
| 3,590,988 | 7/1971 | Hollar | 206/45.34 |
| 3,695,421 | 10/1972 | Wood | 206/523 |
| 3,935,944 | 2/1976 | Wilson et al. | 206/45.34 X |

*Primary Examiner*—Steven E. Lipman
*Attorney, Agent, or Firm*—Leydig, Voit, Osann, Mayer & Holt, Ltd.

[57] ABSTRACT

A package for protection and display of an object such as a clock which includes a base having narrow pedestals extending upwardly along the lateral edges, pedestals having respective overhanging portions extending horizontally inward. The spacing between the pedestals is substantially the same as the lateral dimension of the object and the inside height of the overhanging portions is substantially the same as the height of the object. Embossments are provided on the base presenting a pair of retaining edges spaced inwardly with respect to the front and back edges of the base, the spacing between the embossments being substantially the same as the depth dimension of the object, the base pedestals and embossments being formed of resilient foamed plastic so that the object is held captive and cradled against movement in any direction with respect to the base. The base is enclosed by an inverted cup-shaped shell of transparent plastic having a lower edge snugly conforming to the profile of the base. In the preferred form of the invention the base has a vertical parting plane for separation of the base into two halves facilitating insertion of the object into seated position, addition of the shell causing the two halves to be securely clamped together. Means are provided for securing the shell to the base to discourage disassembly of the shell from the base and tending to insure that the object is viewed only through the shell and remains untouched and in new condition until the time of sale.

19 Claims, 15 Drawing Figures

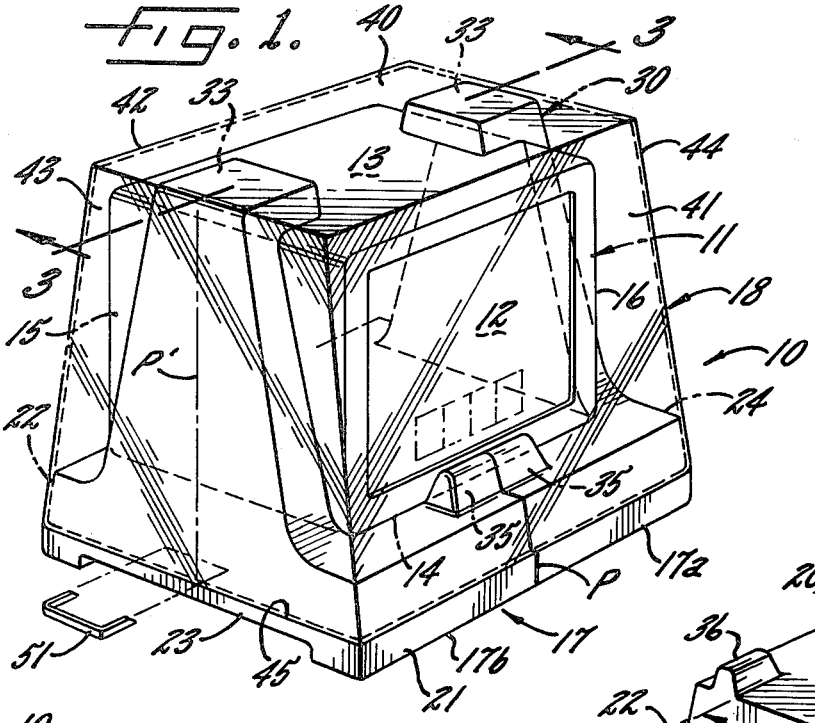
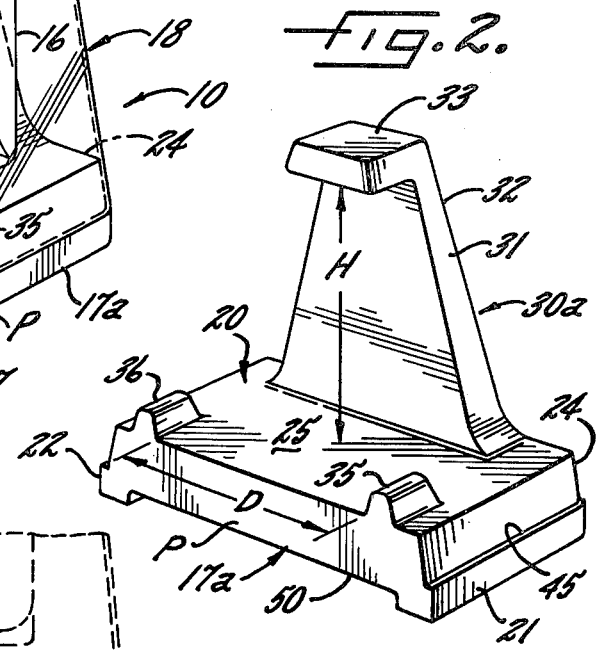
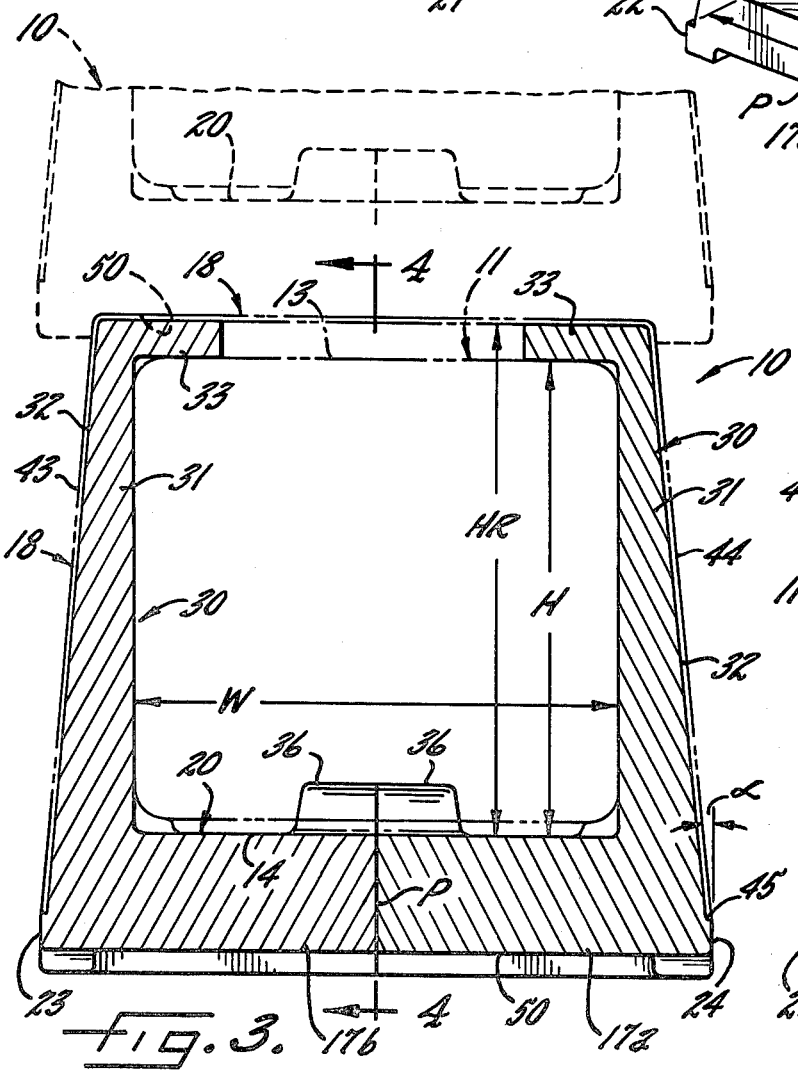
Fig. 3.
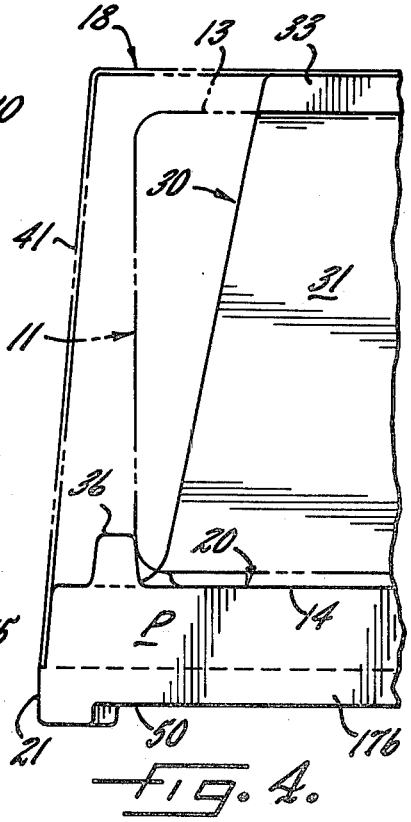
Fig. 4.

PACKAGE FOR PROTECTION AND DISPLAY OF CLOCKS AND THE LIKE

In the packaging of various small objects such as toys and toilet articles it is known to employ a rectangular base with a superimposed transparent shell of inverted cup-shape. Examples of this include U.S. Pat. Nos. 2,498,757—High, 2,563,157—Castelli, 3,185,296—Schlage, 3,533,503—Wood and 4,075,786—van Zyl. Such prior packages do not, however, provide cushioned protection in all three directions combined with full visibility of the goods. It is also known to employ packages utilizing a two-piece support for holding an object to be shipped with a sleeve for holding the parts of the support together. Examples include U.S. Pat. Nos. 2,860,768—Smithers, 3,048,267—Starzec and 4,071,043—Carlson. Such patents, however, do not disclose use of a transparent fitted shell or cover for display purposes. Finally it is known to employ resilient plastic foam in various configurations for floatingly mounting an object in a packing case. Examples of this include U.S. Pat. Nos. 3,040,879—Planitzer, 3,564,811—Freeman, 3,750,871—Cook, 3,938,661—Carmody and 3,930,579—Kurtz. Such devices do not, however, have any provision for display of the goods.

It is, accordingly, an object to provide a package for the storage, shipment and display of a fragile object such as a clock which provides a high degree of protection combined with a high degree of visibility for display purposes. It is a more specific object to provide a protective and display package in which the object is held captive and resiliently cradled against movement in any direction but in which the object is nevertheless substantially in full view through a transparent shell so that there is no necessity for removing the object from the package for purposes of inspection prior to sale. Consequently there is no possibility of the object becoming shop worn and it remains untouched and in new condition until it is in the possession of the final purchaser.

It is still another object of the invention to provide a protective and display package for a clock or the like which is inherently strong, having an inner member including a base and pedestals for cushioning the object in three directions and an outer member in the form of a shell, with the inner and outer members being mutually supportive to provide a high degree of strength and durability in the face of rough handling. In this connection it is an object to provide a package for a clock or the like made of transparent and foamed plastic and which may be manufactured economically using a minimum of plastic material while nevertheless providing a degree of protection which is in excess of that provided by more conventional shipping and display packaging.

It is still another object of the invention to provide a protective and display package which, notwithstanding the fact that it provides support in all three directions of movement, is extremely simple, consisting of a minimum number of parts, with the structure presenting negative clearances yet accommodating the separation required for inserting the object into its seated position quickly and easily, regardless of whether the packing is done manually or by automatic machinery on a production line basis.

It is a related object to provide a protective and display package for a clock or the like which, in its final assembled state, is substantially sealed against entry of dust or moisture, thereby protecting the object, and preserving its appearance, even during storage for a long period or under adverse conditions such as a humid or dusty environment.

It is yet another object of the invention to provide a protection and display package which permits integrated stacking and which includes provision for accommodation, within the base portion, of an accessory, such as a line cord in the case of a clock or other electrical device.

It is a general object of the invention to provide a package for a clock or the like which in addition to its protective and display aspects is itself highly attractive to the extent of enhancing and glamorizing the appearance of the displayed object, attracting attention and sparking interest thereby promoting a sale. Indeed, it is an object to provide a protective and display package which invites handling by a prospective customer, and therefore close viewing, satisfying the curiosity of the customer while keeping the object itself protected and sealed in factory fresh condition.

Other objects and advantages of the invention will become apparent upon reading the attached detailed description and upon reference to the drawings in which:

FIG. 1 is a perspective view showing a package constructed in accordance with the invention containing a clock of rectangular configuration.

FIG. 2 is a perspective view of one of the base-and-pedestal elements employed in FIG. 1.

FIG. 3 is a vertical section looking along line 3—3 in FIG. 1.

FIG. 4 is a fragmentary vertical section looking along line 4—4 in FIG. 3.

Figure 5:
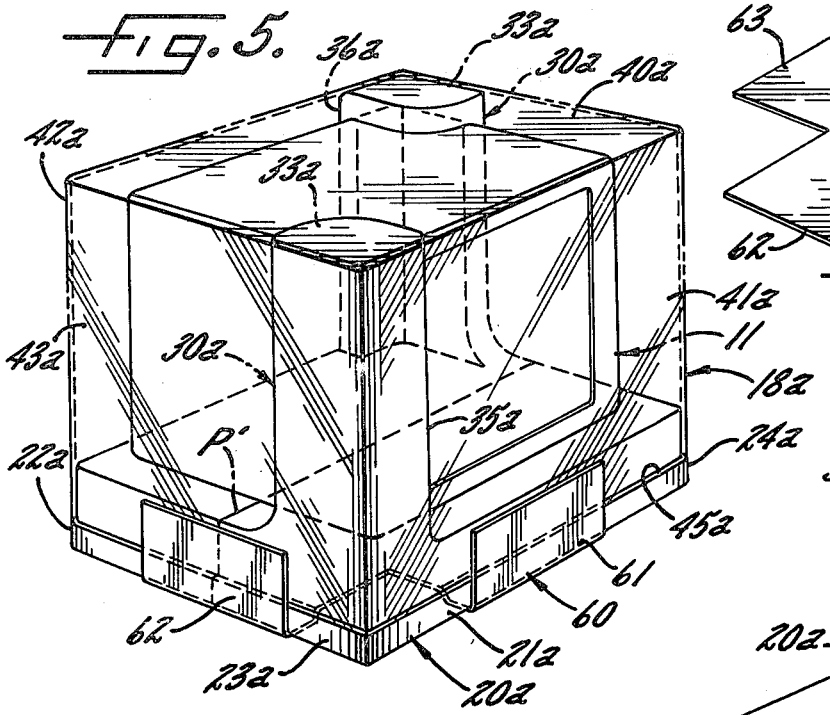
FIG. 5 is a perspective view corresponding to FIG. 1 but showing an alternative form of the present invention.

While the invention has been described in connection with certain preferred embodiments, it will be understood that we do not intend to be limited to the particular embodiments but intend, on the contrary, to cover the various alternative and equivalent forms of the invention included within the spirit and scope of the appended claims.

Turning now to the drawings, there is shown in FIG. 1 a package 10 for the protection and display of an object such as a clock 11, which is shown as being of conventional rectangular shape having a face 12, a top surface 13, a bottom surface 14 and side surfaces 15, 16. The package is made up of an inner assembly 17 which is preferably molded of foamed plastic material with a superimposed shell or cover 18 formed of a plastic which is not only clearly transparent but also strong and durable.

In accordance with the present invention the inner assembly 17 is in the form of a rectangular base which, in the preferred embodiment, is in two sections which are either identical or mirror images of one another and which have been designated 17*a*, 17*b*. The piece 17*a* is illustrated in detail in FIG. 2.

The inner assembly, taken as a unit, includes a flat base 20 having a front edge 21 and back edge 22 and left and right-hand lateral edges 23, 24. The base 20 has a central supporting area 25.

Positioned along the left and right-hand lateral edges are relatively narrow pedestals 30 each having a vertical portion 31 with a presented outer surface 32 and an overhanging portion 33 extending inwardly at the top end thereof. The vertical portions 31 of the pedestals are of elongated generally trapezoidal profile, with inwardly sloping edges facing forwardly and rearwardly, the edges either being straight, as shown, or concaved slightly. Moreover, the pedestals may be narrower than illustrated to provide additional visibility of the sides of the clock, as a compromise with the desired degree of protection, without departing from the invention.

In carrying out the invention the horizontal spacing W between the vertical portions 31 of the pedestals (FIGS. 1 and 3) is substantially equal to the width dimension of the clock. Similarly the inside, or contained, height of the overhanging portions 33 of the pedestals, indicated at H in FIG. 2, is equal to or just slightly greater than the height dimension of the clock. Finally, front and back embossments 35, 36 are provided which present a pair of retaining edges spaced inwardly with respect to the front and back edges of the base and which, between them, define the front to back or "depth" dimension D of the central supporting area 25, the dimension D being substantially the same as the depth dimension of the clock. Thus when the package is assembled together the clock is held captive and cradled against movement in any direction withe respect to the base.

In carrying out the invention the transparent shell or cover 18 which is of inverted cup shape has a top surface 40, front and back surfaces 41, 42 and left and right-hand lateral surfaces 43, 44, the lower edges of the surfaces being dimensioned to conform to the profile of the base. In the preferred and illustrated form of the invention the shell on all four sides has "draft" as indicated at $\alpha$ (FIG. 3) which may, in a practical case, be on the order of 3–5 degrees. Further in accordance with the invention the outwardly presented surfaces 32 of the pedestals are flush with the lateral edges 23, 24 of the base and are tapered at an angle substantially equal to the angle of draft. Thus when the shell is in place there is cooperation between the presented outer surfaces of the pedestals and the inner wall of the shell, preferably "area" contact, to provide mutual reinforcement. Also the headroom within the shell, and which is indicated at HR in FIG. 3 is preferably equal to the overall pedestal height to provide reinforcing engagement between the ceiling of the shell and the overhanging portions 33 of the pedestals, strenghtening the assembly still further.

With the clock or other object dimensionally related to the package as described above, a condition of "negative clearance" is achieved in which the clock is cradled resiliently against movement in all three directions. It is one of the aspects of the present invention, in its preferred form, to provide a vertical parting plane which permits separation of the inner assembly 17 into two opposed half-portions such as 17*a*, 17*b* which may be identical to one another and which enable the clock to be pocketed in place without deforming any of the parts. When the shell is subsequently applied, the two halves of the base are clamped together with the clock or other object being locked between them yet substantially in full view. In the form of the invention illustrated in FIGS. 1–4, the parting plane, indicated at P, runs vertically front-to-back along the centerline. However, the invention is not limited thereto and, if desired, the parting plane may extend through the base and pedestals vertically from left to right along a median plane in a position indicated at P′ in FIG. 1. In either event the base is formed of halves which are of a shape which permits economical molding by use of simple molds, maximum economy being achieved where the halves are identical.

It is one of the features of the invention in its preferred form that the shell does not extend all the way to the foot of the base but the base is, instead, provided with a continuous horizontal ledge which is spaced upwardly from its bottom surface as indicated at 45 in the drawing. The term "continuous" as applied to the ledge 45 is not intended necessarily in the sense of "endless" but is used to indicate the fact that the ledge is elongated.

As a further feature of the present invention, each package has a shallow recess 50 (FIG. 2) in its underside having a reduced dimension which substantially matches the top surface 40 of the shell so that, when the packages are stacked, the base of each unit nestingly receives the top of the unit below it for integration of the stack (FIG. 3). This tends to assure safe and orderly stacking.

It will be apparent that assembly of the unit described above is extremely simple: The clock or other object is simply sandwiched between the two portions of the base by bringing the two portions into alined engagement with one another with the result that the clock is captive against movement in all directions. Subsequently applying the snugly-fitted shell clamps the two portions of the base semi-permanently together, the draft of the shell serving to provide mechanical advantage. When using shallow draft frictional engagement can if desired be relied upon. It is preferred, however, to secure the shell to the base in more positive fashion thereby to discourage disassembly and insuring that the object is viewed only through the shell. The securing means may be in the form of adhesive tape as will be discussed in connection with the alternate embodiment or may, if desired, be in the form of a fastener which penetrates the shell and base in the region of overlap and which has a head which lies intimately adjacent the outer surface of the shell, permitting extraction upon insertion of the point of a knife or prying tool. One simple form of fastener meeting this description is the staple 51 which is illustrated in FIG. 1.

ALTERNATE FORM OF INVENTION

An alternate form of the present invention is disclosed in FIGS. 5–10 inclusive where similar reference numerals have been used to designate similar parts with addition of subscript a.

Figure 6:
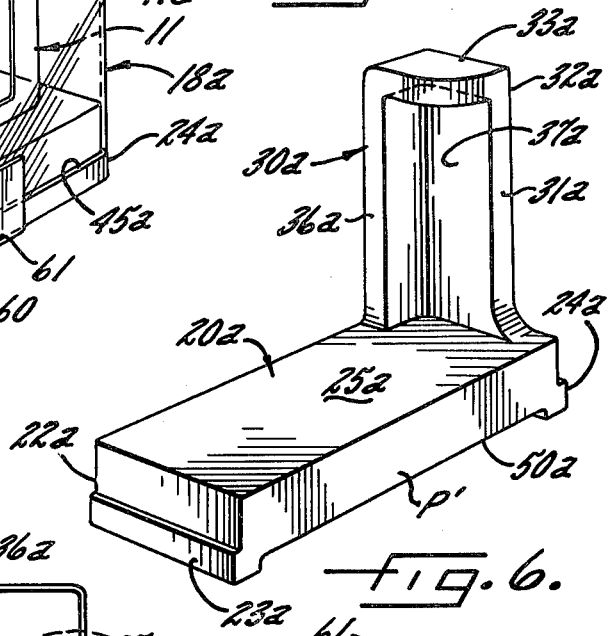
FIG. 6 is a perspective view of a base-and-pedestal utilized in FIG. 5.
Figure 7:
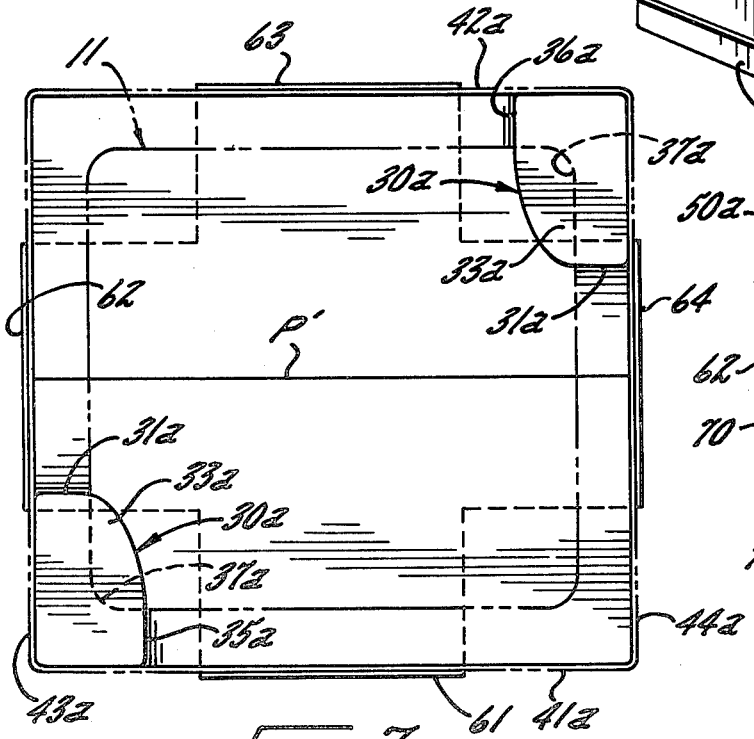
FIG. 7 is a top view of the construction shown in FIG. 5.

Thus the base 20*a* is in two halves separated by a parting plane P′, each of the halves mounting relatively narrow pedestals 30*a* having a vertical portion 31*a* which presents an outer surface 32*a* and having, at the top, an overhanging portion 33*a* extending inwardly from the top end thereof. The pedestals differ in construction from those of the preceding embodiment in that they occupy diagonally related corner positions and, in addition, each of the pedestals has an angular recess for nestingly receiving the presented corner edge of the clock or other object. Referring more specifically to FIG. 6 it will be seen that the pedestal 30*a*, in addition to the wall 31*a*, has a second wall 36*a* arranged at 90 degrees thereto, the two walls, together, forming an angular recess 37*a* into which the corner of the clock is fitted. The second wall 36*a* of the pedestal, in confining the backside of the clock, performs the same function as the embossment 36 of the earlier embodiment and may be conveniently considered as an embossment on the base which has been integrated into, that is, forms a part of, the pedestal.

The benefits of the alternate structure are substantially the same as described: A clock or other contained object is resiliently cradled against movement in all three of the possible directions. Because of the presence of the parting plane P′ assembly is equally simple. The two portions of the base are brought together in alignment, either manually or automatically by an assembling machine, with the clock being captured between them. Subsequent application of the shell or cover 18*a* serves to permanently clamp the inner assembly together, thereby locking the clock in its protected, yet viewable, position.

Figure 8:
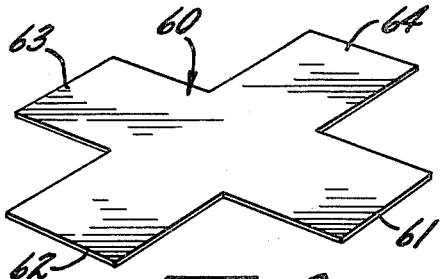
FIG. 8 shows a configuration of adhesive tape employed for sealing the package of FIG. 5.

To maintain the shell seated upon the ledge 45*a* of the base, a strip of adhesive tape 60 may be used, preferably provided in the form of a cross having tabs 61–64 as shown in FIG. 8. With the shell fitted in position the assembly may be superimposed over the tape 60, sticky side up, and the tabs 61–64 are folded upwardly for adhesion to the lower portion of the shell on all four of its sides; preferably, however, the package is inverted before applying the tape. The tape may, if desired, be imprinted with advertising or identifying information. While the tape is of "cross"configuration, it will be understood that such shape may be formed by use of two single strips of tape arranged at right angles to one another. The tape, in addition to keeping the assembly intact, may serve the further purpose of confining, in the recess 50*a* on the underside, instructional or advertising material. It will be apparent that the adhesive tape may be modified by increasing the width of the tabs becoming, in the extreme, a rectangular piece of tape notched at the corners, thereby providing a full encircling strip of advertising display space.

Figure 9:
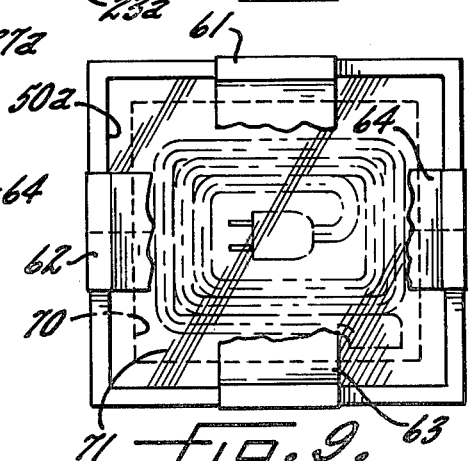
FIG. 9 is a view, at reduced scale, showing the underside of the package with an accessory in the form of a line cord nested in a recess.
Figure 10:
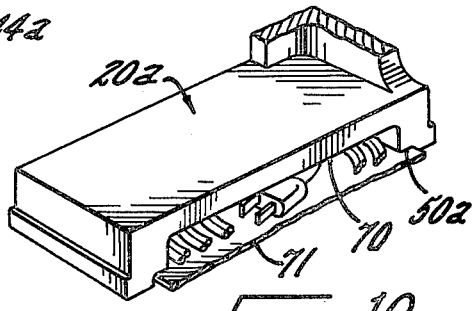
FIG. 10 is a view at reduced scale corresponding to FIG. 6 but illustrating use of the recess.
Figure 11:
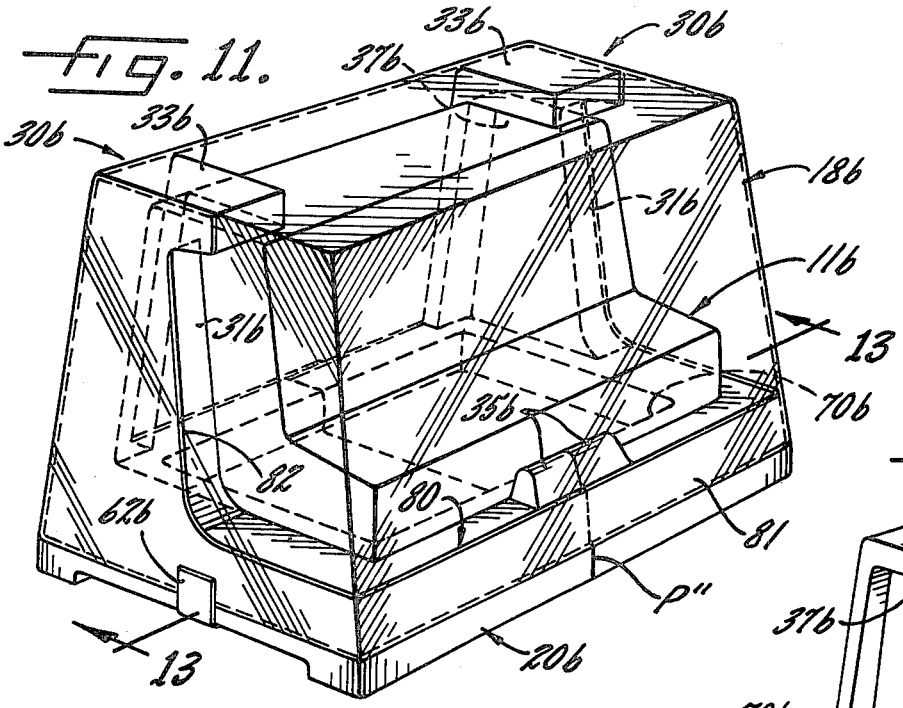
FIG. 11 is a perspective view of a package constructed in accordance with the invention but adapted for a differently shaped clock.

In accordance with one of the more detailed features of the invention the shell recess 50*a* (FIG. 6) may have, at its center, a deeper recess for storing and protecting an accessory which, in the case of an electric clock, might be a line cord. The deeper recess, indicated at 70 in FIGS. 9 and 10 is preferably provided with a closure 71 (see FIG. 10) which may be a sheet of transparent plastic dimensioned to fit in the shallow recess 50*a* and secured therein by any desired means.

With regard to materials of construction, the plastic foam used for the base and pedestals, which are integrally molded, is preferably of the polystyrene type, commonly used as a packing material, either in its natural state or surface-finished. Foam of this type is rather stiffly resilient and it is one of the features of the invention that, due to separation at a parting plane, there is no need to bend or otherwise stress the material in order to overcome the negative clearances which perform the confining function.

Nevertheless it is one of the features of the present construction that the parting line is not essential to the invention in its broader aspects. By use of a relatively soft foam, by reducing the sectional thickness of the pedestals and by designing for lesser amounts of negative clearance (as, for example, by reducing the amount of overhang) it is possible to insert the clock or other object into position by bending the pedestals outwardly, thereby permitting the clock to be squeezed in between them into its seated position. After the clock occupies such position the subsequent application of the shell, which serves to maintain the pedestals in their vertical position, has the effect of locking the clock in place, overcoming any positional hysteresis effect. As an alternative to outward bending of the pedestals, one of the embossments, for example, the embossment 36 (FIG. 2) may be made of reduced height and forcibly by-passed during assembly, thereby maintaining the clock in position by detenting action.

With regard to the material of the outer shell, it is preferably made of transparent polystyrene because of its strength combined with its good molding and optical properties, although other, equivalent, materials may be employed. Because of the mutual reinforcement which occurs in the present construction, as described, a minimum of plastic material is required per unit resulting in a high degree of economy. Economy is maximized by making the two halves of the base portion (illustrated in FIGS. 2 and 6) of identical construction. Nevertheless it will be understood that the term "halves" does not imply identity and the two cooperating pieces may be of unlike size or may be mirror images of one another. It will also be understood that the term "parting plane" is used for convenience as denoting a surface of separation, which surface may, if desired, be jogged or nonplanar, without departing from the invention.

It will be apparent that the objects of the invention have been amply fulfilled: The clock or other object is clearly and almost fully displayed, the front, back and top of the device being virtually free of confinement, while the sides are confined only to slight degree, a degree which may be even further reduced by narrowing the dimension of the pedestals. The package may be handled, and close inspection provides to the curious all of the information which would be provided by handling the object itself. The attractiveness of the package enhances and provides a jewel-like setting for the object which is particularly effective when the packaged object is of relatively small size. Yet the package provides a degree of protection which exceeds that of the usual foam-plus-fiberboard carton. No "outside" covering is necessary and the package is all that is required for shipment, storage and subsequent handling by a stock person or customer.

Since there is no need to remove the clock or other object from the package until the time of actual use, the dealer has the assurance that goods in stock will not become shop worn, and the customer has the incomparable assurance of a factory-sealed package.

One of the advantages of having a downwardly facing recess 70 for cord storage, with the cord penetrating the parting plane, is that the cord may be removed for plugging into a wall outlet on either a continuous or momentary basis to demonstrate electrical features of the clock without requiring disassembly of the package.

FURTHER ALTERNATE FORM OF INVENTION

In a third form of the invention, illustrated in FIGS. 11–15 inclusive, the pedestals occupy both of the rear corner positions and an insert of thin sheet material is sandwiched between the base and the shell for the purpose of carrying a decorative instructional display which is visible through the shell. Similar reference numerals have been used to designate similar parts with addition of subscript b.

The base **20*b* is in two halves separated by a parting plane p", each half mounting pedestals 30*b* which are mirror images of one another having a vertical portion 31*b* and having, at the top, an overhanging portion 33*b*** extending inwardly in two directions. As in the case of the previous embodiment, each pedestal has walls arranged at 90°.

Figure 12:
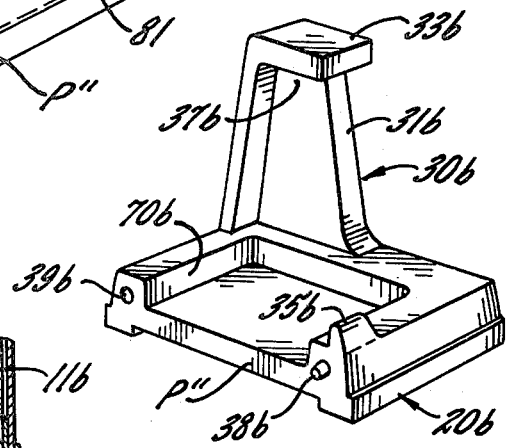
FIG. 12 is a perspective view of one of the base elements.
Figure 13:
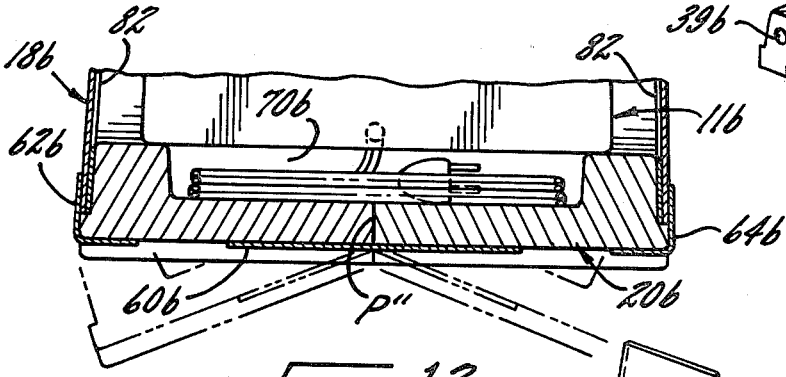
FIG. 13 is a fragmentary vertical section taken along line 13—13 in FIG. 11 showing internal nesting of the line cord.

For the purpose of keying together the two halves of the base, each half is provided with a protuberance, or embossment, **38*b* at the parting plane as well as a recess 39*b* of corresponding size (see FIG. 12**).

The base further includes a cord storage recess **70*b* which is formed in the top of the base, centered in the supporting area, and dimensioned to be hidden from sight when the clock is in position. This leaves the underside of the base free for affixation of an adhesive instructional label 60*a* (FIG. 13) which is generally centered with respect to the parting plane and which serves as a hinge between the two halves of the base enabling spreading movement between the pedestals 30*b* when the shell is removed to free the clock from the base while, nonetheless, keeping the halves of the base connected together, as indicated by the dot-dash lines. Normally the pedestals are clamped inwardly, and prevented from spreading, by the presence of the shell 18*b***.

Figure 14:
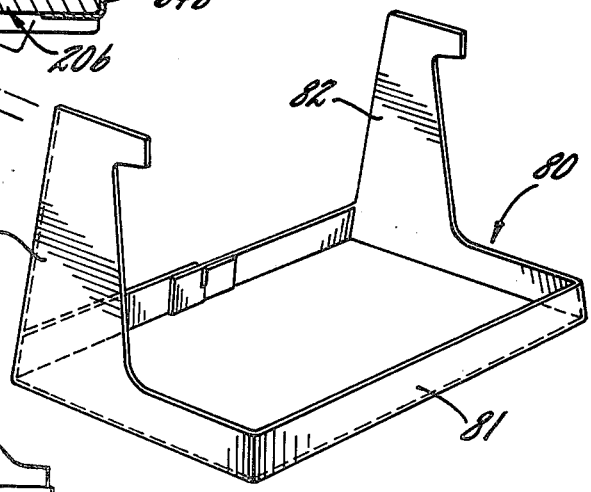
FIG. 14 is a perspective view showing an insert used between the base and the shell and visible for instructional display purposes through the latter.
Figure 15:
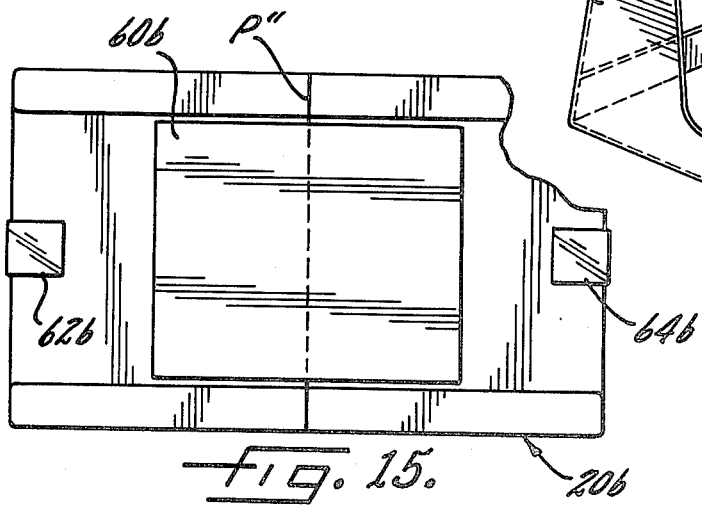
FIG. 15 is an underside view of the package shown in FIG. 11.

In accordance with one of the aspects of the present invention there is, interposed between the surfaces of the base and shell, an insert of thin sheet material, the insert being conformingly limited to the surfaces of the base and pedestals which are in area-engagement with the shell. The insert, generally indicated at 80 in FIG. 14, is in the form of a closed ring 81 of rectangular configuration dimensioned to extend around, and embrace, the base and having integral upright portions 82 which conform to the profile of the pedestals for sandwiching between the pedestals and the shell. The ring 81 and portions 82 together provide instructional display area, clearly visible through the shell, for instructional information and the like relating to the clock or other contained object. The insert performs a number of functions: It is not only decorative and informative but it provides a neater and more finished effect than the rather raw, hard to print surface of the foamed base. It effectively hides the joint at the parting plane, resulting in a more integrated appearance. The loop in addition serves to hold the two halves of the base together when the shell is removed. Finally it serves as a filler or gasket, with the thickness of the cardboard stock being selected to insure a snug fit between the shell on the one hand and the base including its pedestals on the other.

The decorative insert 80, made of relatively thin and inexpensive stock, and the message which is printed upon it, may be provided in several versions depending upon the model and features of a particular clock and may be readily changed, in different manufacturing runs, to be appropriate to the season. Notwithstanding the fact that the insert may be made of thin cardboard stock having little integrity and normally subject to curling and the like as a result of atmospheric changes, the insert in its flatly sandwiched condition constantly presents a neat and tailored appearance, consistently with the jewel-like setting in which the clock or other object is displayed.

What is claimed is:

1. In a package for protection and display of an object such as a clock, the combination comprising a flat base having a central supporting area and having front, back and lateral edges, the base having integral therewith narrow pedestals including vertical portions which extend upwardly along the lateral edges of the base, the pedestals having respective overhanging portions extending horizontally inwardly at the top thereof, the inside spacing between the vertical portions of the pedestals being substantially the same as the lateral dimension of the object, the inside height of the overhanging portions being substantially the same as the height of the object, spaced locating means including an embossment on the base defining the front-to-back dimension of the supporting area and spaced inwardly with respect to the front and back edges of the base, the spacing between the locating means being substantially the same as the depth dimension of the object so that the object is held captive and cradled against movement in any direction with respect to the base, the base having a vertical parting plane permitting separation of the base into two halves for insertion of the object into seated position therebetween, the two halves being each integrally formed of resilient foamed plastic, an inverted cup-shaped shell of transparent plastic having a lower edge conforming to the profile of the base and having sufficient head room as to accommodate the pedestals, the lower edge of the shell being in snug area-engagement with the base and the inner wall of the shell being in mutually supportive area-engagement with the pedestals so that when the shell is applied the two halves of the base are clamped together with the object captive between them yet substantially in full view, and means for temporarily securing the shell to the base to discourage disassembly of the shell from the base and tending to insure that the object is viewed only through the shell and remains untouched and in new condition until the time of sale.

2. In a package for protection and display of an object such as a clock, the combination comprising a flat base having a central supporting area and having front, back and lateral edges, the base having integral therewith narrow pedestals including vertical portions which extend upwardly along the lateral edges of the base, the pedestals having respective overhanging portions extending horizontally inwardly at the top thereof, the spacing between the vertical portions of the pedestals being substantially the same as the lateral dimension of the object, the inside height of the overhanging portions being substantially the same as the height of the object, spaced locating means including an embossment on the base defining the front-to-back dimension of the supporting area and spaced inwardly with respect to the front and back edges of the base, the spacing between the locating means being substantially the same as the depth dimension of the object so that the object is held captive and cradled against movement in any direction with respect to the base, the base, pedestals and embossments being formed of resilient foamed plastic, an inverted cup-shaped shell of transparent plastic having a lower edge conforming to the profile of the base and having sufficient head room as to accommodate the pedestals, the shell being in snug area-engagement with the base and the inner wall of the shell being in mutually supportive area-engagement with the pedestals so that when the shell is applied the two pedestals are clamped in position with respect to the object so that the object is held captive between them yet substantially in full view, means for temporarily securing the shell to the base thereby to discourage disassembly of the shell from the base and tending to insure that the object is viewed only through the shell and remains untouched and in new condition until the time of sale, the degree of overhang being sufficiently limited so that when the shell is removed the object can be moved into and out of its captive position with only limited spreading movement of the pedestals.

3. The combination as claimed in claim 1 or claim 2 in which the locating means comprises a pair of embossments spaced inwardly from the front and back edges, respectively, of the base.

4. The combination as claimed in claim 1 or claim 2 in which the pedestals are of vertically elongated generally trapezoidal profile.

5. The combination as claimed in claim 1 in which the parting plane extends through the base from front to back.

6. The combination as claimed in claim 1 in which the parting plane extends through the base between the lateral edges thereof.

7. The combination as claimed in claim 1 in which the two halves of the base are identical one to the other.

8. The combination as claimed in claim 1 or claim 2 in which the shell has vertical draft so that the top of the cover is of reduced area, each base having a shallow recess on its underside of substantially the same reduced area so that when the packages are stacked the base of each unit nestingly receives the top of the unit below it for integration of the stack.

9. The combination as claimed in claim 1 or claim 2 in which the base has a continuous horizontal ledge formed thereon spaced upwardly from the bottom surface of the base, the lower edges of the shell seating on said ledge to limit the degree of engagement of the cover with the base.

10. The combination as claimed in claim 1 or claim 2 in which the securing means is in the form of adhesive tape underlying the base and having end tabs folded upwardly for adhesion to the lower portion of the shell on at least two of the sides thereof.

11. The combination as claimed in claim 1 or claim 2 in which the securing means is in the form of a cross providing a total of four end tabs folded upwardly for adhesion to the lower portion of the shell on all four sides thereof.

12. The combination as claimed in claim 1 or claim 2 in which the temporary securing means is in the form of a fastener which penetrates the shell and base in the region of overlap, the fastener having a head which lies intimately adjacent the outer surface of the shell and which is subject to extraction upon insertion of the point of a knife or similar prying tool thereunder.

13. The combination as claimed in claim 1 in which the pedestals occupy rear corner positions and in which each of the pedestals has an angular recess for nestingly receiving the presented upper rear corner of the object.

14. The combination as claimed in claim 1 or claim 2 in which the base has a storage recess centered in the supporting area for accommodation of an accessory such as a line cord.

15. The combination as claimed in claim 1 in which the object is an electric clock having a connected line cord and in which the base has a shallow recess on its underside and in which the shallow recess has at its center a deeper recess for accommodation of the line cord with the cord entering the recess via the parting plane, the deeper recess being provided with enclosing means for temporarily retaining the line cord in place while permitting intentional removal thereof for plugging in to demonstrate electrical features of the clock without requiring disassembly of the package.

16. The combination as claimed in claim 1 in which the two halves of the base have integral mating embossments and embossment receptacles at the parting plane to keep the halves of the base in alinement with one another in assembled condition.

17. The combination as claimed in claim 1 or claim 2 in which there is interposed between the surfaces of the base and shell an insert of thin sheet material, the insert being conformingly limited to surfaces of the base and pedestals which are in area-engagement with the shell, the insert including a decorative instructional display visible through the shell and in addition serving as a filler to insure snug fit between the shell and base.

18. The combination as claimed in claim 1 in which there is interposed between the surfaces of the base and shell an insert of thin sheet material, the sheet being in the form of a closed loop encircling the base for instructional display purposes and to hide the joint at the parting plane while holding the two halves of the base together when the shell is removed as well as serving as a filler to insure a snug fit between the shell and the base.

19. The combination as claimed in claim 1 including an adhesive label on the underside of the base, the label being generally centered with respect to the parting plane to serve as a hinge between the two halves of the base enabling spreading movement between the pedestals to free the object while keeping the halves connected with one another.

* * * * *